US009068292B2

(12) United States Patent
Stoffel et al.

(10) Patent No.: US 9,068,292 B2
(45) Date of Patent: Jun. 30, 2015

(54) UNCOATED RECORDING MEDIA

(71) Applicant: HEWLETT-PACKARD DEVELOPMENT COMPANY, L.P., Fort Collins, CO (US)

(72) Inventors: John L. Stoffel, San Diego, CA (US); Thomas Roger Oswald, Eagle, ID (US); Xulong Fu, San Diego, CA (US); Lokendra Pal, San Diego, CA (US); Silke Courtenay, Temecula, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/066,101

(22) Filed: Oct. 29, 2013

(65) Prior Publication Data

US 2014/0209263 A1 Jul. 31, 2014

Related U.S. Application Data

(63) Continuation-in-part of application No. PCT/US2013/023799, filed on Jan. 30, 2013.

(51) Int. Cl.

| | |
|---|---|
| ***D21H 17/28*** | (2006.01) |
| ***D21H 17/63*** | (2006.01) |
| ***D21H 17/66*** | (2006.01) |
| ***D21H 21/16*** | (2006.01) |
| ***D21H 11/08*** | (2006.01) |
| ***D21H 11/10*** | (2006.01) |
| ***D21H 27/00*** | (2006.01) |
| ***D21H 17/67*** | (2006.01) |
| ***B41M 5/00*** | (2006.01) |

(52) U.S. Cl.

CPC ..... *D21H 27/00* (2013.01); *D21H 11/08* (2013.01); *D21H 11/10* (2013.01); *D21H 17/63* (2013.01); *D21H 17/66* (2013.01); *D21H 17/675* (2013.01); *B41M 5/0035* (2013.01)

(58) Field of Classification Search

USPC ..... 162/141, 158, 164.1, 175, 181.1, 181.2, 162/181.4–181.5, 183–185; 399/320; 347/105–106; 428/32.1–32.11, 428/32.18–32.19, 32.21, 32.3

See application file for complete search history.

(56) References Cited

U.S. PATENT DOCUMENTS

| | | | | |
|---|---|---|---|---|
| 3,556,934 | A | 1/1971 | Meyer | |
| 3,779,951 | A | 12/1973 | Streu | |
| 3,884,685 | A | 5/1975 | Green, Jr. et al. | |
| 4,952,278 | A | 8/1990 | Gregory et al. | |
| 6,436,238 | B1 | 8/2002 | Pitkanen et al. | |
| 6,480,298 | B1 | 11/2002 | Sullivan | |
| 6,667,093 | B2 | 12/2003 | Yuan et al. | |
| 6,669,814 | B2 | 12/2003 | Hansen et al. | |
| 6,937,358 | B2 | 8/2005 | Sullivan et al. | |
| 7,037,405 | B2 | 5/2006 | Nguyen et al. | |
| 7,482,046 | B2 | 1/2009 | Williams et al. | |
| 7,497,924 | B2 | 3/2009 | Nguyen et al. | |
| 8,012,312 | B2 | 9/2011 | Goto et al. | |
| 2002/0182376 | A1 | 12/2002 | Mukherjee et al. | |
| 2004/0043200 | A1 | 3/2004 | Masek | |
| 2004/0256067 | A1 | 12/2004 | Leskela et al. | |
| 2005/0003113 | A1 | 1/2005 | Chen et al. | |
| 2006/0260775 | A1 | 11/2006 | Sammarco et al. | |
| 2007/0087138 | A1 | 4/2007 | Koenig et al. | |
| 2009/0236063 | A1 | 9/2009 | Onozuka et al. | |
| 2009/0274855 | A1 | 11/2009 | Koenig et al. | |
| 2009/0317549 | A1 | 12/2009 | Tan et al. | |
| 2009/0320708 | A1* | 12/2009 | Jackson et al. | 101/483 |
| 2011/0012970 | A1* | 1/2011 | Zhou et al. | 347/101 |
| 2011/0104406 | A1 | 5/2011 | Zhou et al. | |
| 2011/0104407 | A1* | 5/2011 | Zhou | 428/32.1 |
| 2011/0205287 | A1 | 8/2011 | Zhou et al. | |

FOREIGN PATENT DOCUMENTS

| | | |
|---|---|---|
| EP | 0755468 | 5/2000 |
| KR | 2012/0016214 | 2/2012 |
| WO | WO 93/22499 | 11/1993 |
| WO | WO 2012/057790 | 5/2012 |
| WO | WO 2012/148405 | 11/2012 |

OTHER PUBLICATIONS

Smook, Gary A., Handbook of Pulp and Paper Terminology, Angus Wilde Publications, 1990, p. 240.*

Lundberg, Anna, et al., "On the Effect of Variations in Paper Composition on Inkjet Print Quality", Digital Printing Center, Mid-Sweden University, 5 pages.

International Search Report and Written Opinion for Application No. PCT/US2013/023799 dated Oct. 21, 2013 (9 pages).

* cited by examiner

*Primary Examiner* — Dennis Cordray

(74) *Attorney, Agent, or Firm* — Dierker & Associates

(57) ABSTRACT

An uncoated recording medium includes a blend of hardwood and softwood chemical pulp fibers, and thermomechanical pulp (TMP) fibers, with total fiber content at least 80 wt % of the medium's total wt %. Hardwood fibers range from about 20 wt % to about 70 wt %, softwood fibers range from about 30 wt % to about 50 wt %, and TMP fibers range from about 10 wt % to about 30 wt %, all relative to the total fiber content. A $TiO_2$ amount ranges from about 1.5 wt % to about 6 wt % of the total wt %, and a bivalent or multivalent salt amount ranges from about 6,000 to about 16,000 μg/gram of the medium. The basis weight ranges from about 45 g/m$^2$ to about 63 g/m$^2$.

34 Claims, 1 Drawing Sheet

UNCOATED RECORDING MEDIA

CROSS-REFERENCE TO RELATED APPLICATIONS

This application is a continuation-in-part of International Application Serial Number PCT/US2013/023799, entitled "Uncoated Recording Media", filed Jan. 30, 2013, which is incorporated herein by reference in its entirety.

BACKGROUND

Media used in laser printing and in inkjet printing often have a weight ranging from about 75 g/m$^2$ (gsm) to about 90 g/m$^2$ (gsm). Media within this weight range may be desirable for laser printing, at least in part because of the opacity characteristics exhibited by the media, as well as the printing performance that is achieved with the media in terms of reduced or eliminated wrinkling and jamming. Media having a weight within the weight range provided above may also be desirable for inkjet printing, at least in part because show through (i.e., strikethrough) is minimized or eliminated.

BRIEF DESCRIPTION OF THE DRAWINGS

Features and advantages of examples of the present disclosure will become apparent by reference to the following detailed description and drawings.

DETAILED DESCRIPTION

Figure 1:
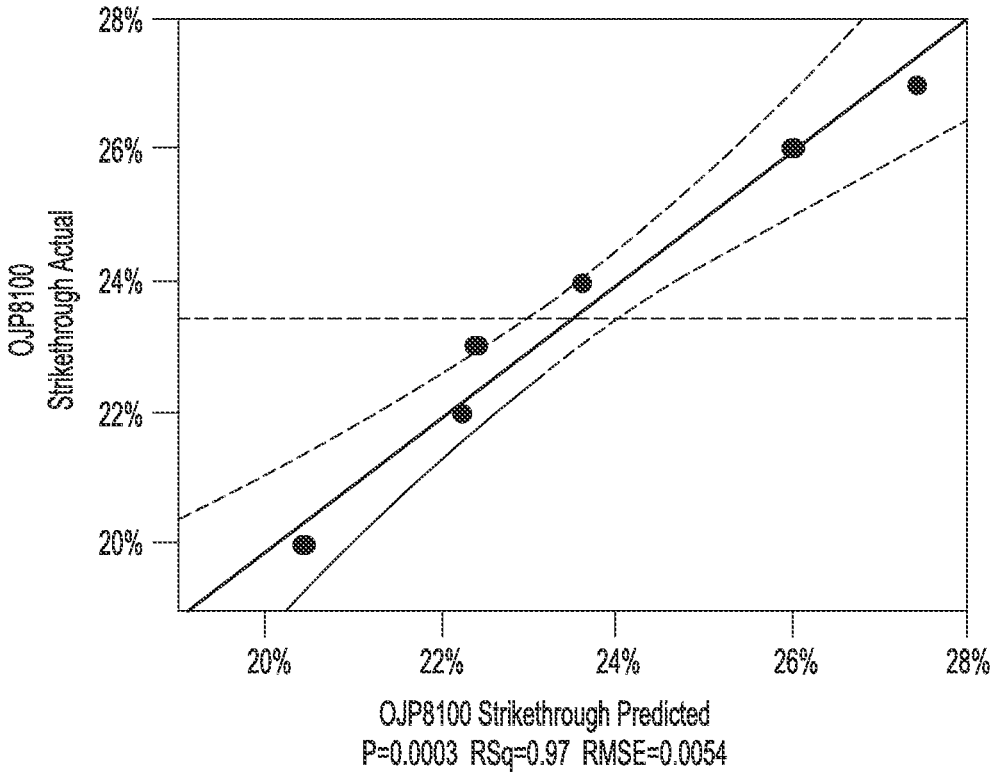
FIG. 1 is a graph illustrating actual ink strikethrough versus predicted ink strikethrough for Samples 1 through 9 of the Example (see also Table 3)

Examples of the uncoated recording medium disclosed herein are light weight cut size papers, which have a basis weight ranging from about 45 g/m$^2$ (gsm) to about 63 g/m$^2$ (gsm). In some instances, the weight ranges from about 50 gsm to about 61 gsm. One difficulty generally encountered when moving to a lower basis weight is avoiding ink or toner strikethrough (i.e., the amount or ink or toner that is printed on one side of the medium that can be seen through the other side of the medium). When the strikethrough percentage is high, the medium may be unsuitable for duplex printing. Examples of the present disclosure advantageously include light weight cut size papers exhibiting a desirable strikethrough percentage.

In examples of the media disclosed herein, a balance between fiber amount (and types of fibers), filler type and amount, and salt amount has been identified. In particular, as the basis weight of the medium is lowered (e.g., by including less fibers and filler overall), it has been found that balancing the salt amount, the titanium dioxide ($TiO_2$) amount, and the amount of thermomechanical pulp fibers (referred to herein as "TMP fibers") is desirable in order to generate a medium that is suitable for duplex printing. It is believed that the balance of the components within the medium disclosed herein unexpectedly results in light weight cut size papers that preserve characteristics and printing quality that are desirable for duplex printing with either laser printers or inkjet printers. The balance between basis weight, $TiO_2$ and salt may aid in reducing inkjet (i.e., inkjet ink) strikethrough while the balance between basis weight and TMP fibers may aid in reducing laser (i.e., toner) strikethrough. In addition, in the examples disclosed herein, relatively high amounts of $TiO_2$ and salt are used without deleteriously affecting other desirable qualities, such as weight, stiffness, opacity, and brightness.

The thin and light-weight examples disclosed herein offer many advantages. For example, fewer raw materials are utilized to manufacture the light weight cut size paper, and the lighter weight of the paper may result in lower shipping costs of the paper itself and of brochures and other products made with the paper. Furthermore, thinner paper requires less storage space than thicker paper in cabinets, printer paper trays, briefcases, etc. In addition, laser printers may utilize less power for fusing toner on thinner paper.

Examples of the uncoated recording medium (i.e., light weight cut size paper) include a pulp (e.g., a chemical pulp) of a blend of hardwood chemical pulp fibers and softwood chemical pulp fibers, as well as (hardwood and/or softwood) fibers formed by mechanical pulping (i.e., TMP fibers).

Examples of suitable hardwood fibers include pulp fibers derived from deciduous trees (angiosperms), such as birch, aspen, oak, beech, maple, and eucalyptus. Examples of suitable softwood fibers include pulp fibers derived from coniferous trees (gymnosperms), such as varieties of fir, spruce, and pine (e.g., loblolly pine, slash pine, Colorado spruce, balsam fir, and Douglas fir). Examples of suitable TMP fibers include the hardwood fibers and/or softwood fibers listed above (e.g., aspen and maple are common TMP fibers, and pine softwood may also be used for TMP fibers).

In an example, the uncoated recording medium includes a blend of bleached chemical northern USA hardwood fibers, bleached chemical southern USA softwood fibers, and Tembec Inc. (Temiscamingue, QC, Canada) Tempcel aspen TMP fibers or Tempcel maple TMP fibers. As examples, the ratio of hardwood chemical pulp fibers to softwood chemical pulp fibers to TMP fibers may be 40:50:10, 40:30:30, 20:50:30, or any ratio therebetween.

The uncoated recording medium has a total fiber content of at least about 80 wt % of the total wt % of the uncoated recording medium. The total fiber content is equal to 100 wt % minus total filler wt % minus wt % of salt and any other ingredients, including, for example, sizing agents and starch. In an example, the total fiber content ranges from about 85 wt % to about 95 wt %.

In examples of the medium of the present disclosure, the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content. The amount of TMP fibers may be tuned in order to decrease the strikethrough when the medium is to be used with laser printers.

The hardwood and softwood chemical pulp fibers may be prepared via any known chemical pulping process. Two suitable chemical pulping methods include the kraft process and the sulphite process.

As used herein, "mechanical pulping" is meant to include two processes. In one process, TMP fibers are prepared by physically grinding wood chips or logs using heat to soften the chips (Thermo-Mechanical Pulp). In the other process, CTMP (Chemi-Thermo-Mechanical Pulp) or BCTMP (bleached Chemi-Thermo-Mechanical Pulp), chemicals are added to assist in softening the wood chips, but at a lower chemical and exposure time level as compared to chemical pulps.

It is to be understood that the hardwood chemical pulp fibers, the softwood chemical pulp fibers, and the TMP fibers used in the examples disclosed herein are not expanded fibers, and the uncoated recording medium does not include any expanded fibers. Expanded fibers are hardwood and/or softwood fibers that have been exposed to a treatment process that expands the fibers. Expanded fibers exhibit a gel-like resistance to settling. One example of a treatment process that forms expanded fibers utilizes a horizontal fine media mill having a 1.5 liter fibrillating zone volume and five impellers. Expanded fibers can be added to increase the strength of the resulting media; however, the light weight cut size paper disclosed herein exhibits a desirable stiffness without the inclusion of expanded fibers.

The uncoated recording medium also includes filler. As mentioned above, the ratio of fiber(s) to filler(s) has been selected to achieve the examples of the light weight cut size paper disclosed herein, which exhibit desirable strikethrough. Compared to commercially available papers having a basis weight ranging from about 75 gsm to about 90 gsm, the examples disclosed herein have a reduced fiber weight and a reduced amount of filler measured as a percentage of the total medium weight. Compared to some other commercially available papers having a basis weight of about 60 gsm, in the examples disclosed herein, the amount of fibers has been increased and the amount of $TiO_2$ has been increased, but the overall amount of filler (e.g., the total amount of $TiO_2$ and another filler, such as $CaCO_3$) has been reduced. In an example, the amount of filler included in the uncoated recording medium ranges from about 5 wt % to about 6.5 wt % of the total wt % of the uncoated recording medium.

Examples of suitable fillers include $TiO_2$ and calcium carbonate (e.g., precipitated calcium carbonate or ground calcium carbonate). In some examples, talc, clay (e.g., calcined clay, kaolin clay, or other phyllosilicates), calcium sulfate, or combinations thereof may be used instead of calcium carbonate or in combination with the $TiO_2$ and the calcium carbonate. An example of a suitable filler combination is precipitated calcium carbonate with $TiO_2$. The combinations may include from about 1.5 wt % to about 6 wt % (of the total wt % of the uncoated recording medium) of the titanium dioxide, and from about 2 wt % to about 5 wt % (of the total wt % of the uncoated recording medium) of the calcium carbonate (precipitated, ground, or a combination thereof). In another example, the combination of calcium carbonate and titanium dioxide includes from about 3.7 wt % to about 4.6 wt % of the calcium carbonate (precipitated, ground, or a combination thereof) and from about 1.6 wt % to about 2.4 wt % of the $TiO_2$. In an example, the filler is a combination of the calcium carbonate(s) and the titanium dioxide and excludes other fillers. Another example filler combination includes kaolin clay and talc with titanium dioxide, with or without other fillers.

$TiO_2$ is commercially available, for example, under the tradename TI-PURE@ RPS VANTAGE® (E. I. du Pont de Nemours and Company). Precipitated calcium carbonate may be obtained by calcining crude calcium oxide. Water is added to obtain calcium hydroxide, and then carbon dioxide is passed through the solution to precipitate the desired calcium carbonate. Precipitated calcium carbonate is also commercially available, for example, under the tradenames OPACARB® A40 and ALBACAR® HO DRY (both of which are available from Minerals Technologies Inc.). Ground calcium carbonate is commercially available, for example, under the trade names OMYAFIL®, HYDROCARB 70®, and OMYAPAQUE®, all of which are available from Omya North America. Examples of commercially available filler clays are KAOCAL™, EG-44, and B-80, all of which are available from Thiele Kaolin Company. An example of commercially available talc is FINNTALC™ F03, which is available from Mondo Minerals.

The uncoated recording medium may also include surface sizing additives, internal starch additives, or internal sizing agents. An example of a suitable surface sizing additive is ethylated starch, which is commercially available under the tradename PENFORD® Gum 270 (Penford Products, Co.). When a surface sizing additive, such as a surface starch additive, is included, the amount used may range from about 30 kg/ton of paper to about 50 kg/ton of paper. In an example, the amount of surface sizing starch additive is about 45 kg/ton of paper (i.e., about 100 lbs/ton of paper). An example of a suitable internal starch additive is a cationic potato starch, which is commercially available under the tradename STA-LOK™ 400, from Tate & Lyle. When an internal starch additive is included, the amount used may range from about 1.5 kg/ton of paper to about 8 kg/ton of paper. In an example, the amount of internal starch additive is about 2.7 kg/ton of paper (i.e., about 6 lbs/ton of paper). Examples of suitable internal sizing agents include alkyl ketene dimer (AKD) and alkenyl succinic anhydride (ASA). AKD is commercially available under the tradename HERCON® 80 (Hercules, Inc.), and may be used in an amount ranging from about 1.0 kg/ton of paper to about 3.0 kg/ton of paper. In an example, the amount of AKD included is about 1.8 kg/ton of paper (i.e., about 4 lbs/ton of paper). When ASA is included, the amount used ranges from about 0.5 kg/ton of paper to about 2.5 kg/ton of paper. In an example, the amount of ASA included is about 1.6 kg/ton of paper (i.e., about 3.5 lbs/ton of paper). For the amounts provided herein in terms of per ton of paper, per grams of paper, etc., it is to be understood that the paper refers to the uncoated recording medium.

The examples of the uncoated recording medium disclosed herein also include a bivalent or multivalent salt, which is added during the paper making process at the size press. Examples of suitable salts include calcium chloride ($CaCl_2$), magnesium chloride ($MgCl_2$), aluminum chloride ($AlCl_3$), magnesium sulfate ($MgSO_4$), calcium acetate ($Ca(C_2H_3O_2)_2$), and combinations thereof. The salt may be added in any amount ranging from about 6,000 μg/gram of medium to about 16,000 μg/gram of medium. Other examples of suitable salt amounts include from about 7,000 μg/gram of medium to about 15,000 μg/gram of medium, from about 6,900 μg/gram of medium to about 14,000 μg/gram of medium, or from greater than 9,500 μg/gram of medium to about 15,000 μg/gram of medium.

It is to be understood that while the salt may be utilized in any example of the uncoated recording medium disclosed herein, the salt may be particularly desirable when the uncoated recording medium is to be used for inkjet (or multipurpose) printing. The addition of the salt may provide the uncoated recording medium with the ability to maintain colorants (e.g., present in inkjet inks) at the surface of the uncoated recording medium, thereby improving show through characteristics (i.e., strikethrough, or the amount of ink printed on one side of the paper that can be seen through the other side of the paper) as well as other printing qualities (black optical density, color saturation, etc.).

In the examples disclosed herein, the combination of basis weight, $TiO_2$ amount, salt amount, and TMP fiber amount is believed to contribute to the low strikethrough that is exhibited by the thin media. Many currently available office papers sold in the United States utilize a large amount of calcium carbonate in order to achieve desirable strikethrough (see the comparative examples in the Example). The results in the Example illustrate that a reduced filler amount may deleteriously affect the strikethrough. The deleterious effect on strikethrough is evidenced by the Canon paper and the Oji paper in the Example which illustrated that a light weight cut size paper containing a reduced amount of calcium carbonate and a trace amount of titanium increased the strikethrough percentage. These comparative examples also included little or no salt. In determining a suitable balance between fiber and filler and salt for obtaining a light weight cut size paper with desirable strikethrough, the present inventors have surprisingly found, in an example, that by increasing the amounts of $TiO_2$ and salt, including a desirable amount of TMP fibers, and decreasing the amount of precipitated calcium carbonate, a light weight cut size paper with desirable ink and toner strikethrough can be achieved.

The uncoated recording medium exhibits a number of properties that render the light weight cut size paper reliable and suitable for a variety of printing techniques. These properties include strikethrough, stiffness (bending and tensile), opacity, and brightness.

Examples of the uncoated recording medium exhibit desirable strikethrough/show through characteristics (e.g., the strikethrough is minimized to such an extent as to be deemed acceptable to a user). In an example, when ink or toner is printed on the medium, a percentage of strikethrough of the ink or toner from the front side of the medium to the back side of the medium ranges from about 14% to about 25%.

To test strikethrough, a simplex printed test plot with a black solid area is placed print side down on a white backing. Reflectance readings are taken on the back side of the paper in an area with no printing and in the area with solid printing. Strikethrough is calculated as the reduction in reflectance, normalized to the paper reflectance, $(1-(R_{solid}\ \text{area}/R_{paper}))\times 100$. A lower strikethrough value indicates that less image is seen through the paper, and therefore, better duplex print quality.

Still further, the inventors of the present disclosure have discovered that strikethrough of examples of the uncoated media can be accurately predicted using two different strikethrough models—one for inkjet printing and one for laser printing.

For the inkjet printing strikethrough model, the amounts of calcium chloride (or other salt), titanium dioxide and basis weight were included in the following linear model:

$$\text{Ink Strikethrough}(\%) = 0.7348 + (-0.00622\times\text{Basis Wt}(gsm)) + (-6.535E^{-6}\times\text{salt}(\mu g/g)) + (-0.03524\times TiO_2(\%))$$

This was advantageously found to explain 97% of the actual ink strikethrough values. See, e.g., the prediction line in FIG. 1 as compared to the actual data points (the actual data points are from actual strikethrough tests run on Samples 1 through 9 of the Example (Table 3, below)). "P" stands for probability value, "RSq" stands for R-squared (R-squared is used to describe how well a regression line fits a set of data, with an R-squared near 1.0 indicating that a regression line fits the data well—the R-squared in the instant case is 0.97), and "RMSE" stands for root mean square error. FIG. 1 shows that this linear model (described in more detail immediately below) is a good model and can be used to predict ink strikethrough for trial points that are not run.

For an example of light weight cut size paper including 14,000 μg/g $CaCl_2$, 5% $TiO_2$, and having a basis weight of 52 gsm, the model predicts an ink strikethrough of about 14%:

$$14\% = 0.7348 + (-0.00622\times 52\ \text{gsm}) + (-6.535E^{-6}\times 14{,}000\ \mu g/g) + (-0.03524\times 5\%).$$

As such, the present inventors have found that examples of the uncoated medium as disclosed herein may be designed to a strikethrough target using the 3 variables noted above in the inkjet printing strikethrough model.

For the laser printing strikethrough model, the amount of TMP fibers and basis weight were included in the following linear model:

$$\text{Toner Strikethrough}(\%) = 0.5885 + (-0.17941\times TMP\ \text{Fibers}(\%)) + (-0.005857\times\text{Basis Wt}(gsm))$$

This was advantageously found to explain 88% of actual toner strikethrough values. See, e.g., the predicted values as compared to the actual data points from actual toner strikethrough tests run on Samples 1 through 9 of the Example (Table 3, below)). As noted above, R-squared is used to describe how well a regression line fits a set of data, with an R-squared near 1.0 indicating that a regression line fits the data well—the R-squared in the instant case is 0.88. Based on the data in the Example, it believed that this linear model (described in more detail immediately below) is a good model and can be used to predict toner strikethrough for trial points that are not run.

For an example of light weight cut size paper including 30% TMP fibers and having a basis weight of 52 gsm, the model predicts a toner strikethrough of about 23%:

$$23\% = 0.5885 + (-0.17941\times 30\%) + (-0.005857\times 52\ \text{gsm}).$$

As such, the present inventors have found that examples of the uncoated medium as disclosed herein may be designed to a toner strikethrough target using the 2 variables noted above in the laser printing strikethrough model.

To achieve both desirable ink strikethrough and toner strikethrough for a single uncoated recording medium, the amounts of $TiO_2$, salt, and TMP fibers, as well as the basis weight may be balanced. Examples of ink and toner strikethrough predictions according to the models are shown in Table 1 below:

TABLE 1

Ink and Toner Strikethrough Examples of model predictions

| | Basis Wt, in gsm | $CaCl_2$, in μg/g | $TiO_2$ Filler, in % | TMP Fibers, in % | Ink Strike-through, in % | Toner Strike-through, in % |
|---|---|---|---|---|---|---|
| Simulation 1 | 52 | 13,000 | 3 | 30 | 22 | 23 |
| Simulation 2 | 60 | 6,000 | 5 | 10 | 15 | 22 |
| Simulation 3 | 52 | 14,000 | 5 | 30 | 14 | 23 |

The examples of the uncoated recording medium disclosed herein have a machine direction Lorentezen & Wetter (L&W) 5 degree bending stiffness of at least 0.11 mNm (milliNewton meters). Some examples of the machine direction L&W 5 degree bending stiffness extend up to 0.21 mNm. The examples of the uncoated recording medium disclosed herein have a cross direction Lorentezen & Wetter (L&W) 5 degree bending stiffness ranging from about 0.07 mNm to about 0.13 mNm. L&W stiffness may be measured, for example, using an L&W bending tester available from Lorentezen & Wetter (see http://www.lorentzen-wettre.com/images/stories/LorentzenWettre/PDF_product_info/LW_Bending_Tester__160.pdf). L&W stiffness is generally measured by holding one end of a sample stationary while bending the other end through a selected angle (e.g., ranging from 0° to 5°). The L&W bending tester is automated and performs these steps. The force to bend the sample is measured by the tester. Bending stiffness is also calculated by the tester using the sample size, bending angle, and force. Stiffness may also be measured in terms of Clark stiffness using, for example, a Clark stiffness tester available from Alat Uji. The stiffness value of examples of the uncoated recording medium disclosed herein provides the light weight cut size paper with sufficient rigidity to keep the paper from wrinkling and/or jamming during printing.

The examples of the uncoated recording medium disclosed herein also have an opacity value of at least 77. In an example, the opacity values ranges from about 77 to about 82. For the examples disclosed herein, the maximum opacity may be up to 82 or even extend beyond 82. Opacity is an optical property of the paper, and may be determined by a ratio of reflectance measurements. TAPPI opacity (i.e., opacity using 89% reflectance backing) is one opacity value that may be used. TAPPI opacity is 100 times the ratio of reflectance of a sample when backed with a black backing to the reflectance of the sample when backed with a white backing having a known reflectance of 89%. As such, opacity is a unitless property. The reflectance measurements may be carried out using a brightness and color meter. Higher opacity values are often obtained when the amount of filler is increased. However, it has been found in the examples disclosed herein that desirable opacity levels may be achieved with a relatively high amount of $TiO_2$ filler, but an overall lower amount of total filler.

As mentioned above, the brightness of examples of the uncoated recording medium is also desirable even though the weight of the paper is reduced. Brightness may be increased with an increased amount of filler (e.g., an increased amount of calcium carbonate and/or $TiO_2$). However, an increased amount of filler may also decrease the stiffness of the paper. The uncoated recording medium disclosed herein has the reduced amount of filler, desirable brightness, and desirable stiffness.

In examples of the uncoated medium disclosed herein, the TAPPI brightness is at least 83. In an example, the TAPPI brightness ranges from about 83 to about 85 (on a standard brightness scale of 1-100). In general, TAPPI brightness may be measured using the TAPPI 452 standard. The test instrument uses a light at 457 nm wavelength, a 45° illumination, and 0° viewing geometry. The standard brightness scale is based on the reflectance of magnesium oxide of 100.0%. It is believed that the TAPPI brightness may be increased by including calcium carbonate and titanium dioxide in amounts at the higher end of the provided ranges. Alternately or additionally, optical brightening agent(s) (OBAs) and/or fluorescent brightening agents (FBAs) may be added to the light weight cut size paper to increase brightness. Basic class types of brighteners include triazine-stilbenes (di-, tetra- or hexa-sulfonated), coumarins, imidazolines, diazoles, triazoles, benzoxazolines, and biphenyl-stilbenes. In an example, the optical brightening agent(s) and/or fluorescent brightening agents may be added in a total amount ranging from about 0.5 kg/ton of paper to about 15 kg/ton of paper. It is to be understood however, that the amount of optical brightening agent(s) and/or fluorescent brightening agent(s) added depends, at least in part, on the type of agent that is used. For example, some agent(s) may be used at lower concentrations than others based on the individual effectiveness and desired whiteness/brightness. The optical brightening agent(s) and/or fluorescent brightening agents may be added in the wet end or in the size press.

In some examples, the uncoated recording medium disclosed herein consists of the fibers, fillers, and salt, with or without the previously mentioned additives, and without any other components that would alter the weight and/or strikethrough of the uncoated recording medium.

The uncoated recording medium may be made using any suitable paper making process. It is to be understood that the process used does not deposit any coating on the recording medium; rather the various ingredients are processed to form a continuous web of light weight paper that can be processed into cut sheet paper in converting operations. Furthermore, the paper making process used does not form any complexes between the fiber and the filler.

In an example, the uncoated recording medium is formed on a Fourdrinier paper machine. The Fourdrinier paper machine consists of a headbox that delivers a stream of dilute fibers and other papermaking ingredients on to a continuously moving wire belt. The water drains through the wire belt, thereby forming a wet mat of fibers. The mat is then pressed and dried. Subsequent operations may add size press/surface additives to improve strength and a calendering step may be used to smooth the paper. In another example, the mat can be formed between two wires using a twin wire paper machine. Paper made by a continuous process, such as Fourdrinier or twin wire paper machines, has directionality. The Machine Direction (MD) of the paper refers to the direction the wire travels. The Cross Direction (CD) of the paper refers to the direction perpendicular to the direction the wire travels. Some physical properties of the paper, such as stiffness (as noted above), will have different values in the MD versus CD.

Figure 2:
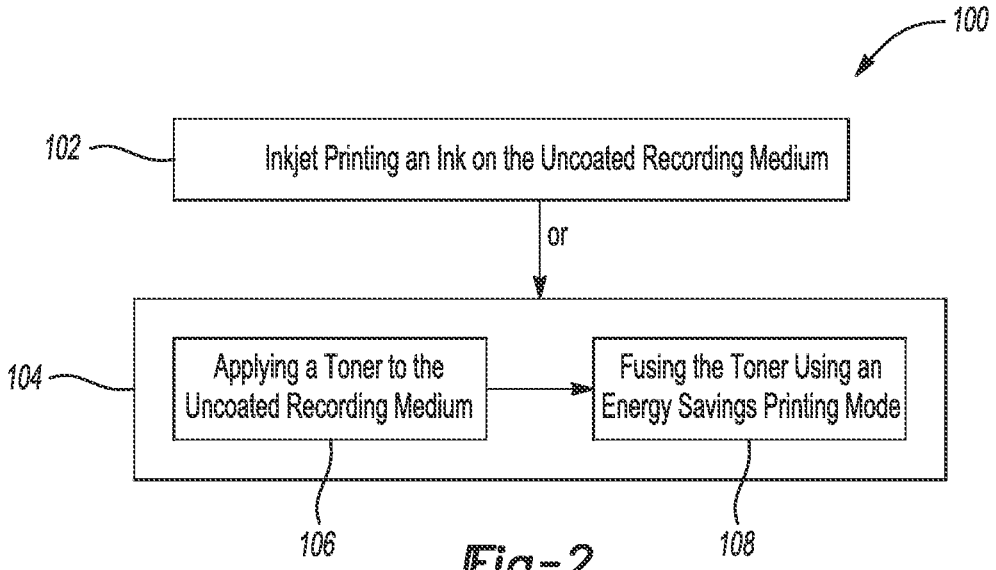
FIG. 2 is a flow diagram illustrating examples of methods of the present disclosure.

As noted above, the examples of the light weight cut size paper disclosed herein may be printed using a variety of printing techniques, including laser printing and inkjet printing. Printing may be accomplished in the typical manner, where the light weight cut size paper is fed into the selected printer, and toner or ink is applied thereto. As shown in FIG. 2, example methods 100 according to example(s) disclosed herein include one of: i) inkjet printing an ink onto a surface of an example of the uncoated recording medium (reference numeral 102); or ii) as shown at reference numeral 104, applying a toner to a surface of an example of the uncoated recording medium (reference numeral 106) and fusing the toner (reference numeral 108). If a toner is applied, the toner fusing may or may not be accomplished using an energy savings printing mode. For example, some laser (i.e., laser jet, enterprise) printers are capable of detecting the light weight cut size paper and automatically initiating an energy savings printing mode that uses a lower temperature for fusing than a printing mode used for higher weight paper. While the light weight cut size paper is actually being printed on in the energy savings printing mode, the overall energy savings may range from about 4% to about 20% in an example, or from about 6% to about 15% in another example.

To further illustrate the present disclosure, an example is given herein. It is to be understood that this example is provided for illustrative purposes and is not to be construed as limiting the scope of the present disclosure.

EXAMPLE

Various examples of thin papers according to the present disclosure were prepared. These examples are labeled Samples 2-7. Samples 1, 8 and 9 illustrate how the various parameters of basis weight, salt amount, and $TiO_2$ amount can be altered to achieve a desirable strikethrough. The respective compositions that were prepared and tested for Samples 1-9 are provided in Table 2 (HW=hardwood chemical pulp fibers, SW=softwood chemical pulp fibers). Commercially available papers of similar basis weights were also utilized in this example, namely Boise Cascade's X-9, OJI's Askul 60 gsm, Johitsu's A4 #14, Clairfontaine Smart Print, Mondi's Maestro Supreme, and Canon's CS 520. The compositions of these papers are also shown in Table 2, although some of these papers may have also included other fillers.

TABLE 2

| Medium Compositions | | | | | | | |
|---|---|---|---|---|---|---|---|
| | HW, % total fiber | SW, % total fiber | TMP, % total fiber | Basis Wt, gsm | $TiO_2$, % | $CaCl_2$, μg/g | $CaCO_3$, % |
| Sample 1 | 70 | 30 | 0 | 61.1 | 0.6 | 11,140 | 4.5 |
| Sample 2 | 50 | 50 | 0 | 62.4 | 2.2 | 6,911 | 3.8 |
| Sample 3 | 40 | 50 | 10 (aspen) | 57.7 | 2.0 | 10,924 | 4.4 |
| Sample 4 | 40 | 50 | 10 (maple) | 59.5 | 2.3 | 9,496 | 3.7 |
| Sample 5 | 20 | 50 | 30 (aspen) | 59.5 | 1.9 | 14,214 | 4.6 |
| Sample 6 | 20 | 50 | 30 (maple) | 62.2 | 1.8 | 12,252 | 4.5 |
| Sample 7 | 40 | 30 | 30 (maple) | 54.8 | 1.9 | 15,545 | 4.4 |
| Sample 8 | 40 | 50 | 10 (maple) | 52.2 | 2.4 | 8,001 | 3.7 |
| Sample 9 | 20 | 50 | 30 (maple) | 50.9 | 1.9 | 13,938 | 4.5 |

| Commercially Available Paper Compositions | | | | | |
|---|---|---|---|---|---|
| | Total Fiber, % | Basis Wt, gsm | $TiO_2$, % | $CaCl_2$, μg/g | $CaCO_3$, % |
| Boise Cascade's X-9 | ~85 | 62.0 | 0 | 1,068 | 11.1 |
| OJI's Askul 60 gsm | ~90 | 60.4 | 0.1 | Not detected | 4.7 |
| Johitsu's A4 #14 | ~85 | 53.6 | 0 | Not detected | 15.3 |
| Clairfontaine Smart Print | ~84 | 53.0 | 0 | 4,874 | 16.1 |
| Mondi's Maestro Supreme | ~85 | 60.2 | 0 | 991 | 11.2 |
| Canon's CS 520 | ~90 | 53.0 | 0.1 | 74 | 5.4 |

Samples 1-9 were tested for ink and toner strikethrough. Predicted ink and toner strikethrough values were also calculated for Samples 1-9 using the inkjet printing strikethrough model and the laser printing strikethrough model provided herein. The commercially available papers were also tested for ink strikethrough. All of the test results and the predicted results are shown in Table 3.

Ink and laser strikethrough were tested using the XRite 938 set to reflectance with Illuminate D65/2 degrees. Inkjet test plots were printed with an HP Office Jet Pro 8100 ink jet printer. Laser test plots were printed with an HP Color LaserJet Enterprise CM4540 multi-function printer. Simplex printed test plots with a black solid area were placed print side down on a white backing. Reflectance readings were taken on the back side of the paper in an area with no printing and in the area with solid printing. Strikethrough was calculated as the reduction in reflectance, normalized to the paper reflectance, $(1-(R_{solid}\ \text{area}/R_{paper}))\times 100$. A lower strikethrough value indicates less image seen through the paper.

As illustrated in Table 3, the predicted results are very similar or the same as the actual results for both ink and toner strikethrough for Samples 1-9. These results indicate that the ink and toner strikethrough equations provided herein may be used to predict that a 52 gsm paper with TiO2 and salt adjusted to medium or high levels (TiO2 1.8 or higher and CaCl2 9,000 μg/g or higher) will generate a paper with as good or better strikethrough than the commercial papers.

TABLE 3

| | Ink Strike-through, % | Predicted Ink Strikethrough, % | Toner Strike-through, % | Predicted Toner Strikethrough, % |
|---|---|---|---|---|
| Medium Disclosed Herein | | | | |
| Sample 1 | 26 | 26 | 24 | 23 |
| Sample 2 | 23 | 22 | 22 | 22 |
| Sample 3 | 24 | 24 | 23 | 23 |
| Sample 4 | 22 | 22 | 20 | 22 |
| Sample 5 | 20 | 20 | 19 | 19 |
| Sample 6 | 20 | 20 | 18 | 17 |
| Sample 7 | 23 | 22 | 21 | 21 |
| Sample 8 | 27 | 27 | 28 | 27 |
| Sample 9 | 26 | 26 | 23 | 24 |
| Commercially Available Papers | | | | |
| Boise Cascade's X-9 | 23 | N/A | N/A | N/A |
| OJI's Askul 60 gsm | 26 | N/A | N/A | N/A |
| Johitsu's A4 #14 | 21 | N/A | N/A | N/A |
| Clairfontaine Smart Print | 24 | N/A | N/A | N/A |
| Mondi's Maestro Supreme | 23 | N/A | N/A | N/A |
| Canon's CS 520 | 38 | N/A | N/A | N/A |

The results in Table 3 also illustrate that each of the Samples 2-7 had comparable or better ink strikethrough than those commercially available papers having higher amounts of total filler. The commercially available papers having reduced amounts of total filler (namely OJI's Askul 60 gsm and Canon's CS 520) had increased ink strikethrough compared to those commercially available papers having higher amounts of total filler, and were also above the higher end (i.e., 25%) of the ink strikethrough of Samples 2-7 disclosed herein.

Tables 2 and 3 together illustrate that none of the commercially available papers achieve desirable ink strikethrough using increased amount of $TiO_2$ and increased amounts of salt. Samples 2-7 achieved this goal (i.e., ink strikethrough no higher than 25% using increased amount of $TiO_2$ and increased amounts of salt).

Samples 1, 8 and 9 exhibited ink strikethrough above the desired value for the examples disclosed herein, and Sample 8 exhibited toner strikethrough above the desired value for the examples disclosed herein. By adjusting the basis weight, $TiO_2$ amount, and/or salt amount, the ink strikethrough can be improved to be within the range of the examples disclosed herein. Generally, one or two of the parameters will be adjusted to compensate for the additional parameter(s). For example, as basis weight is reduced, the $TiO_2$ and/or salt amount is increased to achieve an ink strikethrough within the ranges disclosed herein. Using the ink strikethrough equation provided herein, one can predict suitable adjustments to be made to the compositions in order to achieve the desired ink strikethough. These calculations were performed for Sample 1, 8 and 9 for ink strikethrough, and the results are shown in Table 4.

TABLE 4

Adjusted Medium Compositions and Predicted Ink Strikethrough*

| | HW, % total fiber | SW, % total fiber | TMP, % total fiber | Basis Wt, gsm | $TiO_2$, % | $CaCl_2$, μg/g | $CaCO_3$, % | Predicted Ink Strike-through, % |
|---|---|---|---|---|---|---|---|---|
| Adjusted Sample 1 | 70 (70) | 30 (30) | 0 (0) | 61.0 (61.1) | 2.2 (0.6) | 11,000 (11,140) | 4.5 (4.5) | 21% (26%) |
| Adjusted Sample 8 | 40 (40) | 50 (50) | 10 (10) | 52.2 (52.2) | 2.4 (2.4) | 13,000 (8,001) | 3.7 (3.7) | 24% (27%) |
| Adjusted Sample 9 | 20 (20) | 50 (50) | 30 (30) | 50.9 (50.9) | 2.4 (1.9) | 13,000 (13,938) | 3.7 (4.5) | 25% (26%) |

*Original values in ( ), taken from Tables 2 and 3

As illustrated in Table 4, the predicted ink strikethrough for Sample 1 was improved by increasing the $TiO_2$ amount, the predicted ink strikethrough for Sample 8 was improved by increasing the $CaCl_2$ amount, and the predicted ink strikethrough for Sample 9 was improved by increasing the $TiO_2$ amount and decreasing the $CaCl_2$ amount. It is believed that actual in strikethrough tests would yield comparable strikethrough results.

While not shown in Table 4, it is to be understood that similar adjustments may be made to basis weight, TMP fiber amount, and/or $TiO_2$ amount in order to achieve toner strikethrough within the given range.

For all of Samples 1-9 and the commercially available papers, stiffness, TAPPI brightness, and opacity were measured. Table 5 illustrates all of these results.

Stiffness was measured using a Lorentezen & Wetter (L&W) bending-resistance tester both in the machine direction and in the cross direction. L&W stiffness was measured by holding one end of a sample stationary while and bending the other end through an angle (e.g., ranging from 0° to 5°). The force to bend the sample was measured. Bending stiffness was calculated by the tester using the sample size, bending angle, and force. The geometric mean was also calculated by taking the square root of the MD stiffness multiplied by the CD stiffness. The geometric mean is used to calculate a single number that characterizes the overall stiffness of the sheet.

The TAPPI brightness was measured using TAPPI Standard T452, "Brightness of pulp, paper, and paperboard (directional reflectance at 457 nm)". ISO 2470 brightness was measured using illuminant C and 2° observer conditions.

Opacity was tested using TAPPI test method T425. In accordance with this test method, a reflectance measurement was made on a sheet of paper backed by a black backing, $R_0$. Another reflectance measurement was made on the sheet backed by an 89% reflective tile, $R_{0.89}$. Opacity=$100 \times R_0/R_{0.89}$. Higher opacity values indicate that it is more difficult to see through the sheet of paper.

TABLE 5

| | Bending Stiffness 5 d, mNm MD | Bending Stiffness 5 d, mNm CD | Bending Stiffness 5 d, Geo. Mean | TAPPI brightness | Opacity |
|---|---|---|---|---|---|
| Medium Disclosed Herein | | | | | |
| Sample 1 | 0.188 | 0.093 | 0.132 | 84 | 78 |
| Sample 2 | 0.168 | 0.093 | 0.125 | 85 | 80 |
| Sample 3 | 0.165 | 0.087 | 0.120 | 84 | 80 |
| Sample 4 | 0.174 | 0.108 | 0.137 | 85 | 81 |
| Sample 5 | 0.198 | 0.121 | 0.155 | 83 | 81 |
| Sample 6 | 0.205 | 0.132 | 0.165 | 83 | 82 |
| Sample 7 | 0.146 | 0.103 | 0.123 | 84 | 81 |
| Sample 8 | 0.115 | 0.069 | 0.089 | 85 | 78 |
| Sample 9 | 0.133 | 0.078 | 0.102 | 83 | 77 |
| Commercially Available Papers | | | | | |
| Boise Cascade's X-9 | 0.152 | 0.093 | 0.119 | 92 | 84 |
| OJI's Askul 60 gsm | 0.237 | 0.108 | 0.160 | 84 | 82 |
| Johitsu's A4 #14 | 0.092 | 0.032 | 0.054 | 86 | 83 |
| Clairfontaine Smart Print | 0.138 | 0.059 | 0.091 | 98 | 81 |
| Mondi's Maestro Supreme | 0.196 | 0.098 | 0.139 | 95 | 82 |
| Canon's CS 520 | 0.125 | 0.072 | 0.095 | 86 | 79 |

The commercially available papers having a basis weight ranging from 54 to 62 gsm exhibit ink strikethrough of 21 to 23% (Tables 2 and 3). The Johitsu paper at 53.6 gsm achieves a moderate low ink strikethrough number with a high calcium carbonate filler level. The high filler level trades improvement in strikethrough for lower, or poor, stiffness (Table 5). The results in tables 2, 3, and 5 for Samples 2-7 together illustrate that using a higher amount of $TiO_2$ and salt (generally in combination with a lower amount of $CaCO_3$) achieves moderate low to low strikethrough (i.e., 25% or less), and does not deleteriously affect or improves, stiffness, brightness, and opacity.

It is to be understood that the ranges provided herein include the stated range and any value or sub-range within the stated range. For example, a range from about 1.5 wt % to about 6 wt % should be interpreted to include not only the explicitly recited limits of about 1.5 wt % to about 6 wt %, but also to include individual values, such as 1.8 wt %, 2 wt %, 3.2 wt %, etc., and sub-ranges, such as from about 1.75 wt % to about 4.5 wt %, from about 1.9 wt % to about 3 wt %, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content, and wherein the blend includes a ratio of the hardwood chemical pulp fibers to the softwood chemical pulp fibers to the TMP fibers selected from 40:50:10, 40:30:30, and 20:50:30;

titanium dioxide present in an amount ranging from about 1.5 wt % to about 6 wt % of the total wt % of the uncoated recording medium; and a bivalent or multivalent salt present in an amount ranging from about 6,000 μg per gram of the uncoated recording medium to about 16,000 μg per gram of the uncoated recording medium;

the uncoated recording medium having a basis weight ranging from about 45 g/m$^2$ to about 63 g/m$^2$.

2. The uncoated recording medium as defined in claim 1 wherein the bivalent salt is calcium chloride ($CaCl_2$), magnesium chloride ($MgCl_2$), or combinations thereof.

3. The uncoated recording medium as defined in claim 1, further comprising a calcium carbonate filler selected from the group consisting of precipitated calcium carbonate and ground calcium carbonate.

4. The uncoated recording medium as defined in claim 3 wherein the calcium carbonate filler is present in an amount ranging from about 2 wt % to about 5 wt % of the total wt % of the uncoated recording medium.

5. The uncoated recording medium as defined in claim 1 wherein:

the amount of the titanium dioxide ranges from about 2 wt % to about 3 wt % of the total wt % of the uncoated recording medium; and the amount of the bivalent or multivalent salt ranges from about 6,900 μg per gram of the uncoated recording medium to about 14,000 μg per gram of the uncoated recording medium.

6. The uncoated recording medium as defined in claim 1 wherein the amount of the bivalent or multivalent salt ranges from greater than 9,500 μg per gram of the uncoated recording medium to about 15,000 μg per gram of the uncoated recording medium.

7. The uncoated recording medium as defined in claim 1 wherein the medium has a TAPPI brightness of at least 83 and an opacity of at least 77.

8. The uncoated recording medium as defined in claim 1, further comprising a surface sizing additive, an internal starch additive, and any of alkyl ketene dimer or alkenyl succinic anhydride.

9. A printing method comprising one of:

i) inkjet printing an ink onto a surface of the uncoated recording medium as defined in claim 1; or ii) applying a toner to a surface of the uncoated recording medium as defined in claim 1, and fusing the toner utilizing an energy savings printing mode.

10. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

titanium dioxide present in an amount ranging from about 1.5 wt % to about 6 wt % of the total wt % of the uncoated recording medium; and a bivalent or multivalent salt present in an amount ranging from about 6,000 μg per gram of the uncoated recording medium to about 16,000 μg per gram of the uncoated recording medium;

the uncoated recording medium having a basis weight ranging from about 45 g/m$^2$ to about 63 g/m$^2$;

wherein when ink is printed on the medium, a percentage of strikethrough of the ink from a front side of the medium to a back side of the medium ranges from about 14% up to 25%;

and wherein the percentage of strikethrough of the ink, the basis weight, the amount of bivalent or multivalent salt, and the amount of $TiO_2$ satisfy the following equation:

$$\text{Ink Strikethrough}(\%) = 0.7348 + (-0.00622 \times \text{Basis Wt}(gsm)) + \left(-6.535E^{-6} \times \text{salt}\left(\frac{\mu g}{g}\right)\right) + (-0.03524 \times \text{TiO}_2(\%)).$$

11. The uncoated recording medium as defined in claim 10 wherein the bivalent salt is calcium chloride ($CaCl_2$), magnesium chloride ($MgCl_2$), or combinations thereof.

12. The uncoated recording medium as defined in claim 10, further comprising a calcium carbonate filler selected from the group consisting of precipitated calcium carbonate and ground calcium carbonate.

13. The uncoated recording medium as defined in claim 12 wherein the calcium carbonate filler is present in an amount ranging from about 2 wt % to about 5 wt % of the total wt % of the uncoated recording medium.

14. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

titanium dioxide present in an amount ranging from about 1.5 wt % to about 6 wt % of the total wt % of the uncoated recording medium; and a bivalent or multivalent salt present in an amount ranging from about 6,000 μg per gram of the uncoated recording medium to about 16,000 μg per gram of the uncoated recording medium;

the uncoated recording medium having a basis weight ranging from about 45 g/m$^2$ to about 63 g/m$^2$;

wherein when toner is printed on the medium, a percentage of strikethrough of the toner from a front side of the medium to a back side of the medium ranges from about 14% up to 25%;

and wherein the percentage of strikethrough of the toner, the basis weight, and the amount of TMP fibers satisfy the following equation:

$$\text{Toner Strikethrough (\%)} = 0.5885 + (-0.17941 \times TMP\ \text{Fibers (\%)}) + (-0.005857 \times \text{Basis Wt}\,(gsm)).$$

15. The uncoated recording medium as defined in claim 14 wherein the bivalent salt is calcium chloride ($CaCl_2$), magnesium chloride ($MgCl_2$), or combinations thereof.

16. The uncoated recording medium as defined in claim 14, further comprising a calcium carbonate filler selected from the group consisting of precipitated calcium carbonate and ground calcium carbonate.

17. The uncoated recording medium as defined in claim 16 wherein the calcium carbonate filler is present in an amount ranging from about 2 wt % to about 5 wt % of the total wt % of the uncoated recording medium.

18. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

titanium dioxide present in an amount of about 2.4 wt % of the total wt % of the uncoated recording medium; and a bivalent or multivalent salt present in an amount of about 14,000 μg per gram of the uncoated recording medium;

wherein the uncoated recording medium has a basis weight of about 61 g/m$^2$;

and wherein when ink is printed on the medium, a percentage of strikethrough of the ink from a front side of the medium to a back side of the medium is about 18%.

19. The uncoated recording medium as defined in claim 18 wherein the bivalent salt is calcium chloride ($CaCl_2$), magnesium chloride ($MgCl_2$), or combinations thereof.

20. The uncoated recording medium as defined in claim 18, further comprising a calcium carbonate filler selected from the group consisting of precipitated calcium carbonate and ground calcium carbonate.

21. The uncoated recording medium as defined in claim 20 wherein the calcium carbonate filler is present in an amount ranging from about 2 wt % to about 5 wt % of the total wt % of the uncoated recording medium.

22. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

titanium dioxide present in an amount of about 5 wt % of the total wt % of the uncoated recording medium; and a bivalent or multivalent salt present in an amount of about 6,000 μg per gram of the uncoated recording medium;

wherein the uncoated recording medium has a basis weight of about 60 g/m$^2$;

and wherein:

when ink is printed on the medium, a percentage of strikethrough of the ink from a front side of the medium to a back side of the medium is about 15%; or when toner is printed on the medium, a percentage of strikethrough of the toner from the front side of the medium to the back side of the medium is about 22%.

23. The uncoated recording medium as defined in claim 22 wherein the bivalent salt is calcium chloride ($CaCl_2$), magnesium chloride ($MgCl_2$), or combinations thereof.

24. The uncoated recording medium as defined in claim 22, further comprising a calcium carbonate filler selected from the group consisting of precipitated calcium carbonate and ground calcium carbonate.

25. The uncoated recording medium as defined in claim 24 wherein the calcium carbonate filler is present in an amount ranging from about 2 wt % to about 5 wt % of the total wt % of the uncoated recording medium.

26. An uncoated recording medium, comprising:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

titanium dioxide present in an amount of about 5 wt % of the total wt % of the uncoated recording medium; and a bivalent or multivalent salt present in an amount of about 14,000 μg per gram of the uncoated recording medium;

wherein the uncoated recording medium has a basis weight of about 52 g/m$^2$;

and wherein:

when ink is printed on the medium, a percentage of strikethrough of the ink from a front side of the medium to a back side of the medium is about 14%; or when toner is printed on the medium, a percentage of strikethrough of the toner from the front side of the medium to the back side of the medium is about 23%.

27. The uncoated recording medium as defined in claim 26 wherein the bivalent salt is calcium chloride ($CaCl_2$), magnesium chloride ($MgCl_2$), or combinations thereof.

28. The uncoated recording medium as defined in claim 26, further comprising a calcium carbonate filler selected from the group consisting of precipitated calcium carbonate and ground calcium carbonate.

29. The uncoated recording medium as defined in claim 28 wherein the calcium carbonate filler is present in an amount ranging from about 2 wt % to about 5 wt % of the total wt % of the uncoated recording medium.

30. An uncoated recording medium, consisting of:

a blend of hardwood chemical pulp fibers, softwood chemical pulp fibers, and thermomechanical pulp (TMP) fibers, wherein a total fiber content is at least 80 wt % of a total wt % of the uncoated recording medium, and wherein the hardwood chemical pulp fibers are present in an amount ranging from about 20 wt % to about 70 wt % relative to the total fiber content, the softwood chemical pulp fibers are present in an amount ranging from about 30 wt % to about 50 wt % relative to the total fiber content, and the TMP fibers are present in an amount ranging from about 10 wt % to about 30 wt % relative to the total fiber content;

a combination of titanium dioxide and calcium carbonate, an amount of the titanium dioxide ranging from about 1.5 wt % to about 5 wt % of the total wt % of the uncoated recording medium, and an amount of the calcium carbonate ranging from about 3.5 wt % to about 5 wt % of the total wt % of the uncoated recording medium;

calcium chloride ($CaCl_2$) present in an amount ranging from about 6,000 μg per gram of the uncoated recording medium to about 15,000 μg per gram of the uncoated recording medium; and optionally a size press starch additive, an internal starch additive, any of alkyl ketene dimer or alkenyl succinic anhydride, or combinations thereof;

the uncoated recording medium having a basis weight ranging from about 50 g/m$^2$ to about 61 g/m$^2$, and wherein when ink or toner is printed on the medium, a percentage of strikethrough of the ink or toner from a front side of the medium to a back side of the medium ranges from about 14% to 25%.

31. The uncoated recording medium as defined in claim 30 wherein:

the amount of the titanium dioxide ranges from about 2 wt % to about 3 wt % of the total wt % of the uncoated recording medium; and the amount of the $CaCl_2$ ranges from greater than 9,500 μg per gram of the uncoated recording medium to about 14,000 μg per gram of the uncoated recording medium.

32. The uncoated recording medium as defined in claim 30 wherein:

the amount of the titanium dioxide is about 5 wt % of the total wt % of the uncoated recording medium;

the amount of the $CaCl_2$ is about 6,000 μg per gram of the uncoated recording medium;

the basis weight is about 60 g/m$^2$; and ink strikethrough of the medium is about 15%; or toner strikethrough of the medium is about 22%.

33. The uncoated recording medium as defined in claim 30 wherein:

the amount of the titanium dioxide is about 5 wt % of the total wt % of the uncoated recording medium;

the amount of the $CaCl_2$ is about 14,000 μg per gram of the uncoated recording medium;

the basis weight is about 52 g/m$^2$; and ink strikethrough of the medium is about 14%; or toner strikethrough of the medium is about 23%.

34. The uncoated recording medium as defined in claim 30 wherein the blend includes a ratio of the hardwood chemical pulp fibers to the softwood chemical pulp fibers to the TMP fibers selected from 40:50:10, 40:30:30, and 20:50:30.

* * * * *